US011197101B2

(12) United States Patent
Lee

(10) Patent No.: US 11,197,101 B2
(45) Date of Patent: Dec. 7, 2021

(54) MICRO SPEAKER CAPABLE OF PREVENTING VOICE COIL RUBBING

(71) Applicant: CONCRAFT HOLDING CO., LTD., Grand Cayman (KY)

(72) Inventor: Kuo-Chi Lee, New Taipei (TW)

(73) Assignee: CONCRAFT HOLDING CO., LTD., Grand Cayman (KY)

( * ) Notice: Subject to any disclaimer, the term of this patent is extended or adjusted under 35 U.S.C. 154(b) by 0 days.

(21) Appl. No.: 16/991,716

(22) Filed: Aug. 12, 2020

(65) Prior Publication Data

US 2021/0352411 A1 Nov. 11, 2021

(30) Foreign Application Priority Data

May 6, 2020 (TW) ..... 109115282

(51) Int. Cl.

| | |
|---|---|
| ***H04R 9/04*** | (2006.01) |
| ***H04R 9/02*** | (2006.01) |
| ***H04R 7/04*** | (2006.01) |
| ***H04R 31/00*** | (2006.01) |
| ***H04R 9/06*** | (2006.01) |
| ***H04R 7/18*** | (2006.01) |

(52) U.S. Cl.

CPC ..... *H04R 9/046* (2013.01); *H04R 7/04* (2013.01); *H04R 7/18* (2013.01); *H04R 9/025* (2013.01); *H04R 9/06* (2013.01); *H04R 31/003* (2013.01); *H04R 2307/025* (2013.01); *H04R 2400/11* (2013.01)

(58) Field of Classification Search

CPC . H04R 7/04; H04R 7/18; H04R 9/046; H04R 9/045; H04R 9/025; H04R 9/06; H04R 2307/025; H04R 2400/11

See application file for complete search history.

(56) References Cited

U.S. PATENT DOCUMENTS

| | | | | |
|---|---|---|---|---|
| 8,995,704 | B2 * | 3/2015 | Huang | H04R 9/043 381/404 |
| 9,813,818 | B2 | 11/2017 | Wu et al. | |
| 10,003,887 | B2 | 6/2018 | Linghu et al. | |
| 10,299,045 | B2 | 5/2019 | Xiao et al. | |
| 10,448,167 | B2 | 10/2019 | Xiao et al. | |
| 2019/0230441 | A1 * | 7/2019 | Xiao | H04R 1/02 |

* cited by examiner

*Primary Examiner* — Sunita Joshi

(74) *Attorney, Agent, or Firm* — Muncy, Geissler, Olds & Lowe, P.C.

(57) ABSTRACT

A micro speaker capable of preventing voice coil rubbing, including an outer casing provided with a holding space, a diaphragm installed within the holding space, a magnet provided with an axis, a voice coil encircling the exterior of the magnet and connected to a diaphragm, and an elastic connecting member connected between the voice coil and the magnet. The diaphragm is disposed on the first end, and the magnet is disposed on the second end of the holding space so as to be separated from the diaphragm. The elastic connecting member is used to maintain a clearance between the voice coil and the magnet. After a signal voltage is fed into the voice coil, the diaphragm extends along the axis causing amplitudes of vibration, and the elastic connecting member reduces amplitudes of deflection produced along the axis, thereby preventing rubbing between the voice coil and the magnet from occurring.

12 Claims, 8 Drawing Sheets

MICRO SPEAKER CAPABLE OF PREVENTING VOICE COIL RUBBING

BACKGROUND OF THE INVENTION

(a) Field of the Invention

The present invention relates to a micro speaker, and more particularly to a micro speaker that is able to emit sound after a signal voltage is fed in, and is also able to prevent rubbing noise from occurring, as well as enabling micro-miniaturization thereof.

(b) Description of the Prior Art

Micro speakers are primarily used in devices able to emit sound, such as mobile devices, earphones, or speakers. Micro speakers of the prior art primarily use an internally disposed voice coil that encircles the exterior of a magnet. When a signal voltage is fed into the voice coil, the voice coil is used to cut magnetic lines of force that enables producing an applied force; the applied force then drives a diaphragm to produce up and down amplitudes of vibration, whereby the air is set in motion to emit the corresponding sound.

However, the small size of the micro speaker limits the space inside, which results in a reduced clearance between the voice coil and the magnet. Hence, rubbing between the voice coil and the magnet easily results when the voice coil is producing up and down amplitudes of vibration along the axis of the magnet, which causes a slight rubbing noise to accompany the emitted sound from the micro speaker.

Hence, the present market has proposed structures and methods to resolve the rubbing between the voice coil and the magnet, such as U.S. Pat. Nos. 8,995,704, 9,813,818, 10,003,887, 10,448,167, and 10,299,045, The above patents primarily dispose an elastic connecting member between a voice coil and an outer casing, wherein the elastic connecting member is used to enable maintaining a clearance between the voice coil and the magnet, further preventing rubbing between the voice coil and the magnet when the voice coil is producing up and down amplitudes of vibration. Although such a method is able to effectively improve the problem of producing rubbing sounds, however, this method requires maintaining a relatively large space between the voice coil and the outer casing in order to conveniently assemble the elastic connecting member. Consequently, the size of the micro speaker is restricted, and thus incapable of being developed toward further microminiaturization.

Hence, the problem to be solved by the present invention involves providing a micro speaker capable of preventing voice coil rubbing and enables effective miniaturization thereof.

SUMMARY OF THE INVENTION

The main object of the present invention lies in providing a micro speaker, and more particularly to a micro speaker able to emit sound after a signal voltage is fed in and prevent producing rubbing noise, as well as enable miniaturization thereof.

In order to achieve the aforementioned objects, the present invention provides a micro speaker capable of preventing voice coil rubbing, comprising at least an outer casing, a diaphragm, a magnet, a voice coil, and an elastic connecting member. The center of the outer casing is provided with a holding space, which is provided with a first end and a second end corresponding thereto. The diaphragm is assembled on the first end of the holding space, and the magnet is provided with an axis and assembled on the second end of the holding space so as to be separated from the diaphragm. One end of the voice coil encircles and is positioned on the outer side of the magnet, and the other end is connected to the diaphragm. A signal voltage fed into the voice coil drives the diaphragm to extend in the direction of the axis to produce amplitudes of vibration. The elastic connecting member is connected between the voice coil and the magnet to enable maintaining a clearance therebetween, which reduces amplitudes of deflection produced along the axis while the voice coil is causing amplitudes of vibration.

In one embodiment, the elastic connecting member further comprises at least a frame and at least an elastic member, wherein the frame is used to support the voice coil, and the elastic member is connected between the frame and the magnet.

In one embodiment, the frame is further assembled from a plurality of frame mounts, each of which is separated from each other; moreover, the elastic members are respectively disposed between each of the frame mounts and the magnet.

In the embodiment, a connecting rod is further used to connect between each of the mutually separated frame mounts.

In the embodiment, the magnet assumes an oblong shape, comprising two corresponding long sides and two corresponding short sides, wherein each of the long sides and each of the short sides are adjacent to each other with an arc-shaped side formed therebetween.

Each of the frame mounts is disposed on the outer side of each of the arc-shaped sides; moreover, each of the elastic members are connected between each of the frame mounts and each of the arc-shaped sides.

In one embodiment, the frame mounts are respectively disposed on the outer sides of the two long sides and the two short sides. In addition, elastic members are respectively disposed between each of the frame mounts, each of the long sides, and each of the short sides.

In one embodiment, an attaching layer is further provided on the exterior surface of the magnet.

In the embodiment, the outer casing is further assembled from a weight bearing seat and a main casing, wherein the first end is formed on the weight bearing seat, and is used to support the weight of the diaphragm; the second end is formed on the main casing, and circumferentially located on the exterior of the voice coil. Moreover, the weight bearing seat is assembled on the upper portion of the main casing.

In the embodiment, the diaphragm and the weight bearing seat are formed as an integral body, with the diaphragm made from silicone material, wherewith an injection molding method is used to form the diaphragm on the weight bearing seat.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
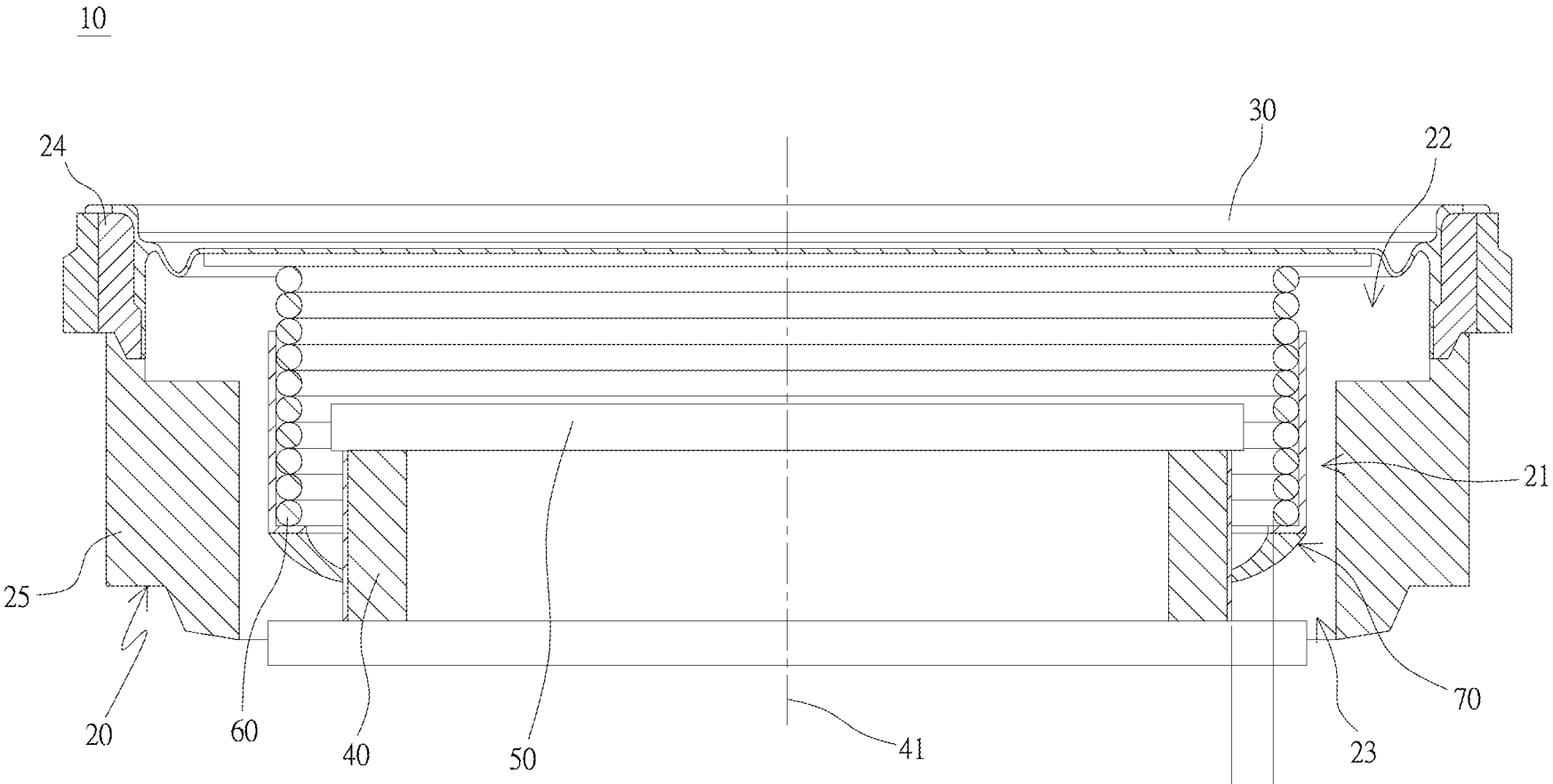
FIG. 1 is a cross-sectional schematic view of a micro speaker of the present invention.

Regarding the detailed content and structural means of the present invention, please refer to the description of the diagrams as follows:

Referring to FIGS. 1 to 5, the present invention first provides a micro speaker capable of preventing voice coil rubbing, wherein a micro speaker 10 comprises an outer casing 20, a diaphragm 30, a magnet 40, a washer 50, a voice coil 60, and an elastic connecting member 70.

The center of the outer casing 20 is provided with a holding space 21, the interior of which is provided with a first end 22 and a second end 23, wherein the first end 22 and the second end 22 correspond to each other. In the present embodiment, the outer casing 20 is assembled from a weight bearing seat 24 and a main casing 25, wherein the first end 22 is positioned at the weight bearing seat 24, the second end 23 is positioned at the main casing 25, and the weight bearing seat 24 is assembled on the upper portion of the main casing 25.

The diaphragm 30 is assembled on the end periphery of the first end 22 of the holding space 21. In the present embodiment, the diaphragm 30 is made from silicone material, wherewith an injection molding method is used to form an integral body with the weight bearing seat 24. The method used to form the integral body involves first placing the weight bearing seat 24 into a mold (a method that belongs to prior art, and thus not shown in the drawings), then liquid silicone material is injected into the mold. The diaphragm 30 is directly formed on the weight bearing seat 24 after the silicone material has cooled down and forms inside the mold, which enables the diaphragm 30 and the weight bearing seat 24 to be formed as an integral body.

The magnet 40 is assembled to the second end 23 of the holding space 21 and is covered by the outer casing 20. Moreover, the magnet 40 is separated from the diaphragm 30 and is provided with an axis 41, which is perpendicular to the diaphragm 30. In the present embodiment, the magnet 40 assumes an oblong shape, comprising two long sides 42 and two short sides 43, wherein each of the long sides 42 and each of the short sides 43 are correspondingly adjacent to each other. In addition, an arc-shaped side 44 is formed between each of the adjacent long sides 42 and the short sides 43. The washer 50 covers the magnet 40.

The voice coil 60 is disposed inside the holding space 21; one end of the voice coil 60 is connected to the diaphragm 30 and the other end is made to encircle the exterior of the magnet 40 and the washer 50. A clearance 61 is formed between the magnet 40 and the voiced coil 60. The voice coil 60 is wound around and formed from metal wire material such as enamel-covered wire, copper wire, aluminum wire, or copper-clad aluminum wire. Further, the two ends of the enamel-covered wire are respectively connected to an external power source (a method that belongs to prior art and thus not further detailed herein). An electric current is produced after a signal voltage is fed into the voice coil 60, and the voice coil 60 is used to cut magnetic lines of force, which further produces an applied force that drives the diaphragm 30 to extend along the axis 41, producing amplitudes of vibration that cause the diaphragm 30 to set in motion the air and emit a corresponding sound.

Figure 2:
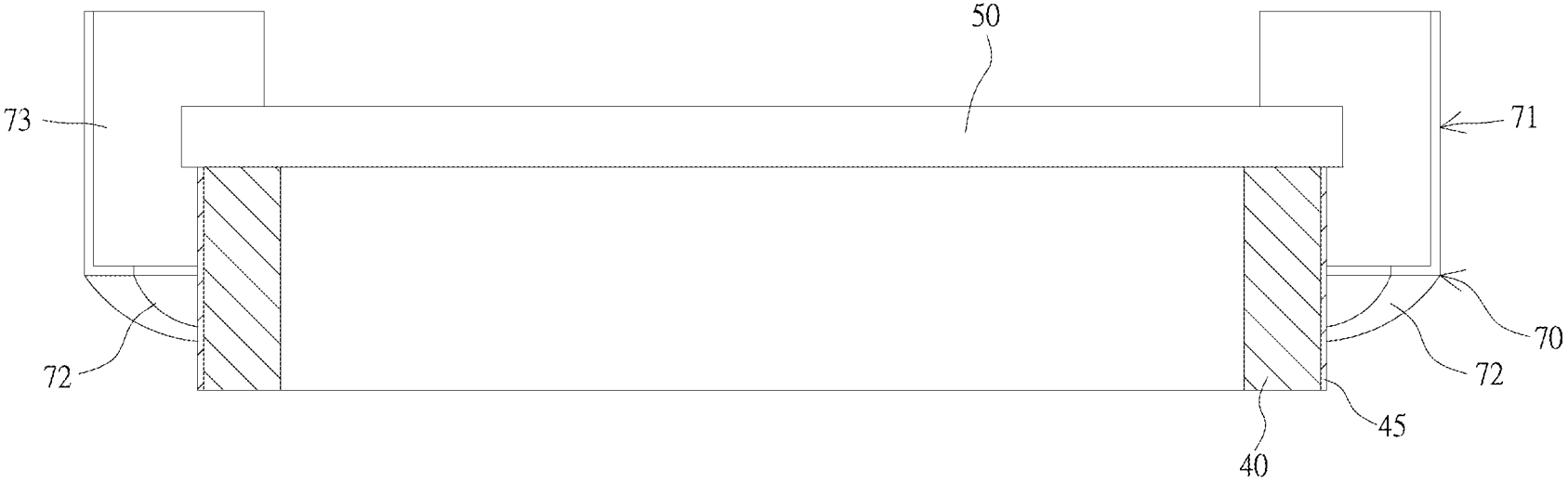
FIG. 2 is a cross-sectional schematic view of a first embodiment mode of an elastic connecting member of the present invention.
Figure 3:
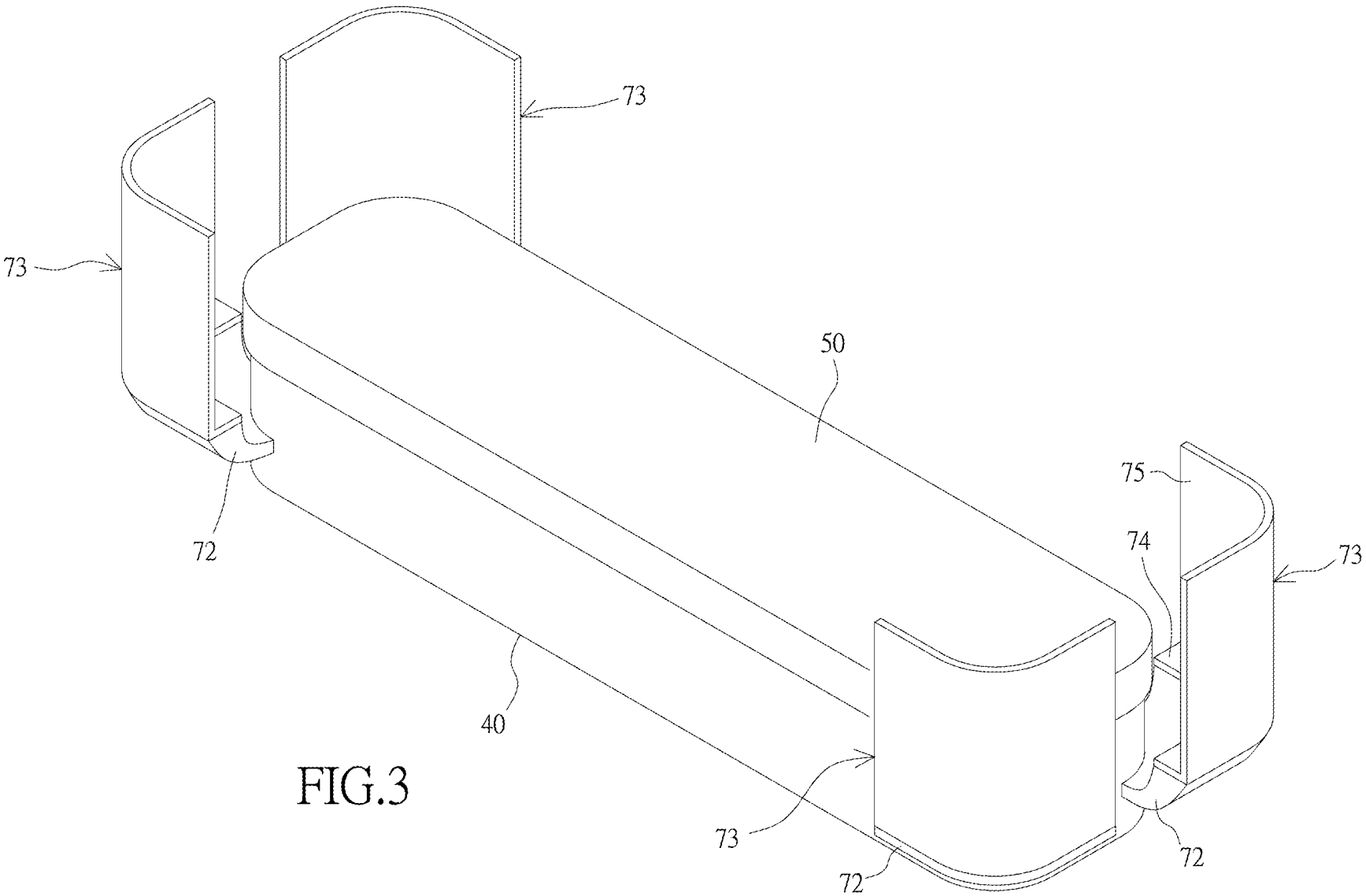
FIG. 3 is an assembled schematic view of the first embodiment mode of the elastic connecting member of the present invention.

The elastic connecting member 70 is connected between the magnet 40 and the voice coil 60, and the elastic connecting member 70 is used to maintain the appropriate clearance 61 between the magnet 40 and the voice coil 60. The elastic connecting member 70 is assembled from at least a frame 71 and at least an elastic member 72. In the present embodiment, the frame 71 is assembled from four frame mounts 73, which are disposed so as to be separated from each other; moreover, each of the frame mounts 73 is adjacently disposed on the outer sides of each of the arc-shaped sides 44 of the magnet 40. In addition, the elastic members 72 are respectively disposed between each of the frame mounts 73 and the arc-shaped sides 44. Each of the frame mounts 73 assumes an L-shape (as shown in FIG. 2) and comprises a connecting side 74 and an abutting side 75, wherein the connecting sides 74 are located on the lower side of the voice coil 60, and the abutting sides 75 are located on the outer side of the voice coil 60. An adhesion, high frequency, or injection molding method is used to connect each of the frame mounts 73 to the voice coil 60, whereby each of the elastic members 72 are connected between the connecting side 74 and the arc-shaped sides 44. In the present embodiment, the elastic members 72 are respectively formed between the connecting sides 74 and the arc-shaped sides 44 using an injection molding method with silicone material. The method used to form the elastic members 72 involves first placing the frame mounts 73 and the magnet 40 into a second mold (a method that belongs to prior art, and thus not shown in the drawings), then liquid silicone material is injected into the molding space of the second mold. The elastic members 72 are formed inside the molding space after the silicone material has cooled down, which enables effective binding of the elastic members 72 between the connecting sides 74 and the arc-shaped sides 44. The shape of the elastic members 72 can be changed by modifying the shape of the molding space. Furthermore, because the magnet 40 and the elastic members 72 are fabricated from different materials, thus, in order to enable the elastic members 72 to effectively bind to the magnet 40 during the molding process, in the present embodiment, an attaching layer 45 is first formed on the exterior surface of the magnet 40 using a coating or injection molding method, wherein the attaching layer 45 is similarly formed using silicone material. Accordingly, during the molding to process, the elastic members 72 are able to effectively bind with the attaching layer 45 to further increase the binding force between the elastic members 72 and the magnet 40.

Hence, after a signal voltage is fed into the voice coil 60, amplitudes of vibration are established on the magnet 40, with the elastic connecting member 70 enabling maintaining the clearance 61 between the voice coil 60 and the magnet 40, and reduce extension of the voice coil 60 along the axis 41 producing left and right deflection phenomena, further effectively preventing rubbing between the voice coil 60 and the magnet 40.

It is worth mentioning that the larger the radius of each of the arc-shaped sides 44 of the magnet 40, the larger the clearance 61 between each of the arc-shaped sides 44 and the frame mounts 73, accordingly, the sized of the elastic members 72 is correspondingly larger. Hence, in the present invention, the clearance 61 between the arc-shaped sides 44 and the frame mounts 73 is controlled by controlling the radius of the arc-shaped sides 44, further, the shape of the elastic members 72 is effectively modified according to the size of the amplitudes of vibration, thereby enabling effectively maintaining the clearance 61 between the voice coil 60 and the magnet 40. In addition, reducing the distance between the outer casing 20 and the voice coil 60 enables achieving an effective reduction in the size of the entire micro speaker 10.

Figure 4:
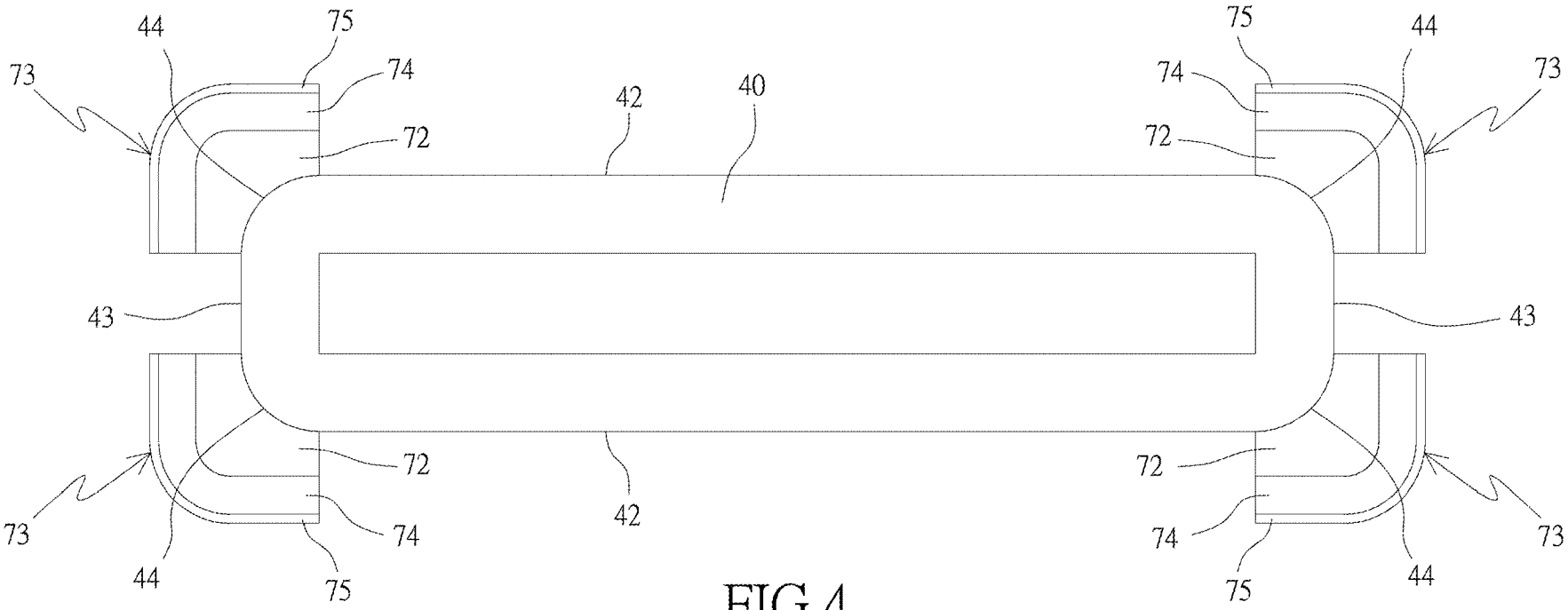
FIG. 4 is a top view of the first embodiment mode of the elastic connecting member of the present invention.
Figure 5:
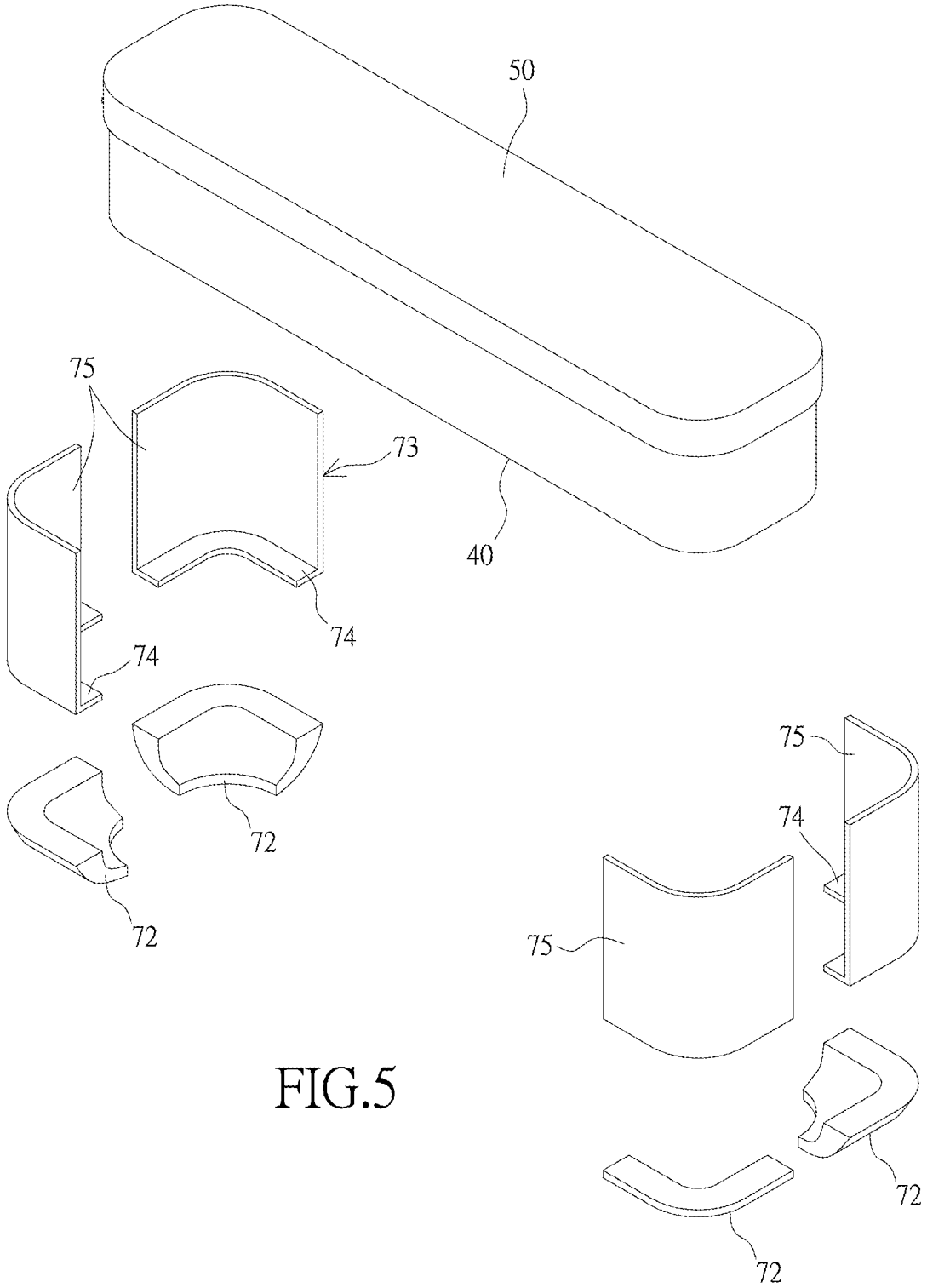
FIG. 5 is an exploded schematic view of the first embodiment mode of the elastic connecting member of the present invention.
Figure 6:
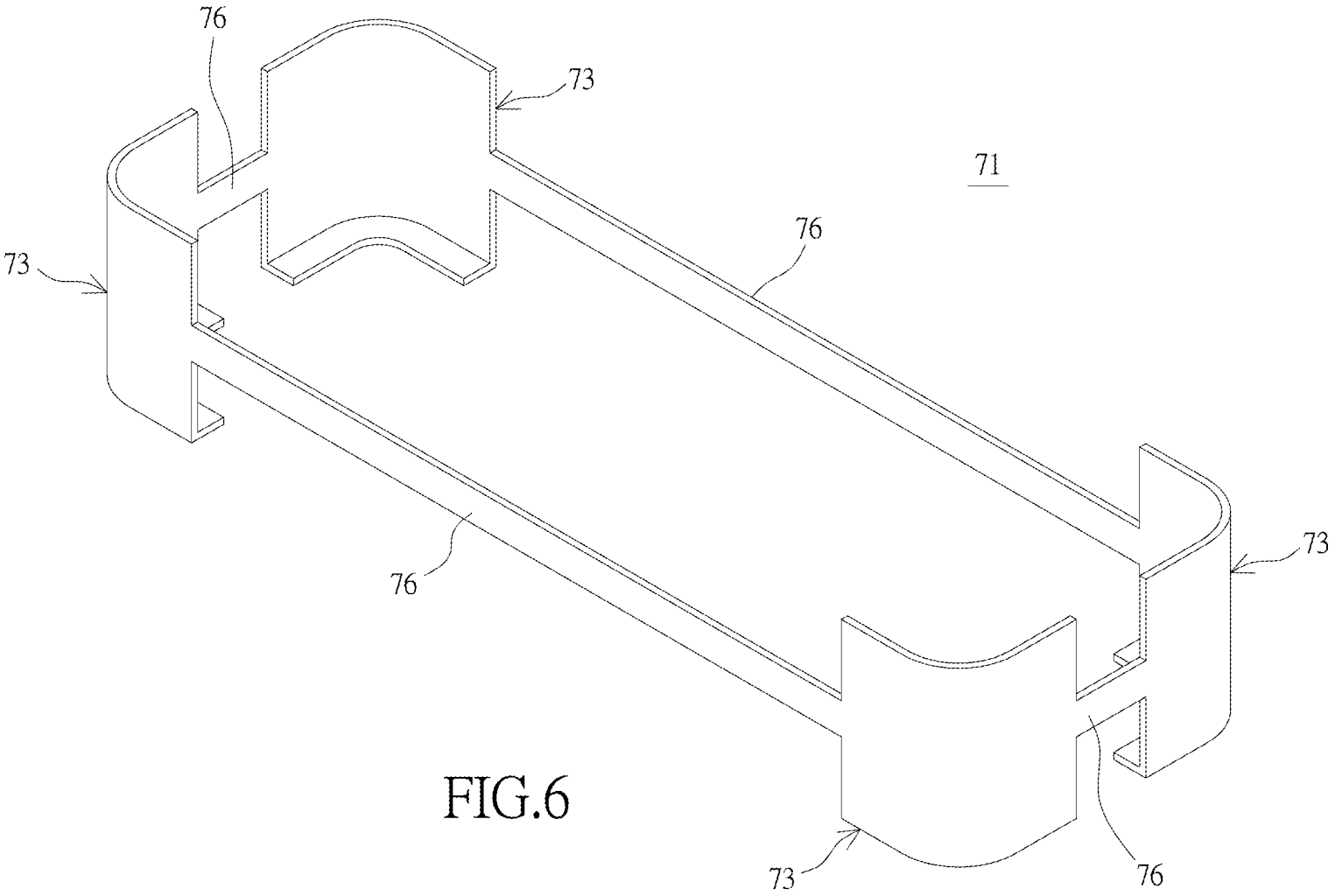
FIG. 6 is a second embodiment mode of the elastic connecting member of the present invention.

Referring to FIGS. 4 and 6, in order to save on molding time of the elastic members 72 between the frame mounts 73 and the magnet 40, in the present embodiment, a connecting rod 76 is configured between each of the mutually separated frame mounts 73, wherein the two ends of each of the connecting rods 76 are respectively connected to the frame mounts 73. Accordingly, the frame mounts 73 are concurrently placed together with the connecting rods 76 inside the above-described second mold, thus eliminating the need to separately place each of the frame mounts 73 into the second mold, and thus shortening the time needed to place the frame mounts 73 into the second mold. Moreover, after each of the connecting rods 76 have formed on each of elastic member 72, the connecting rods 76 can be either left between the frame mounts 73 or the connecting rods 76 can be removed from between the frame mounts 73 (as shown in FIG. 4) to lighten the weight of the frame 71.

Figure 7:
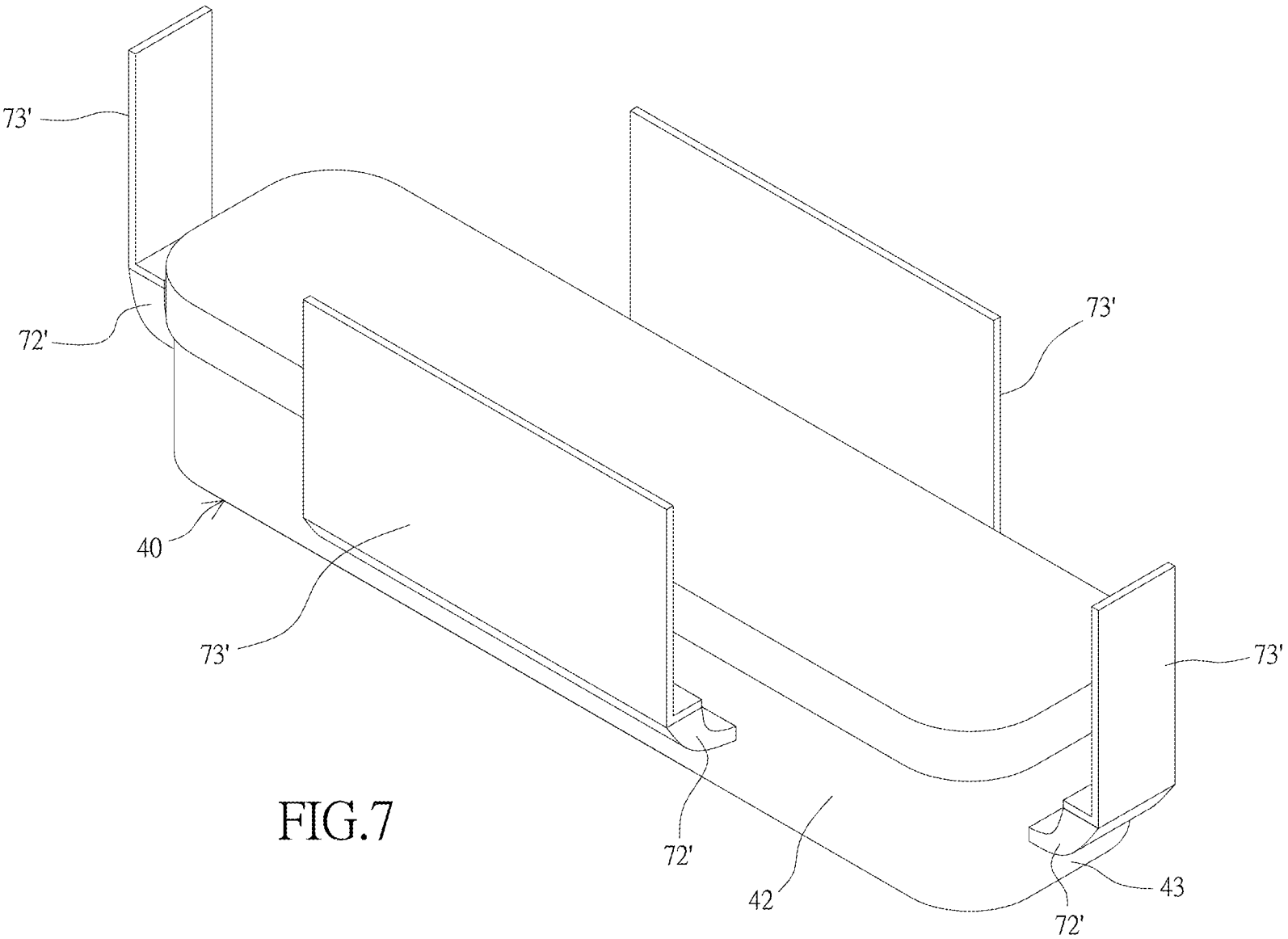
FIG. 7 is an assembled schematic view of a third embodiment mode of the elastic connecting member of the present invention and a magnet.
Figure 8:
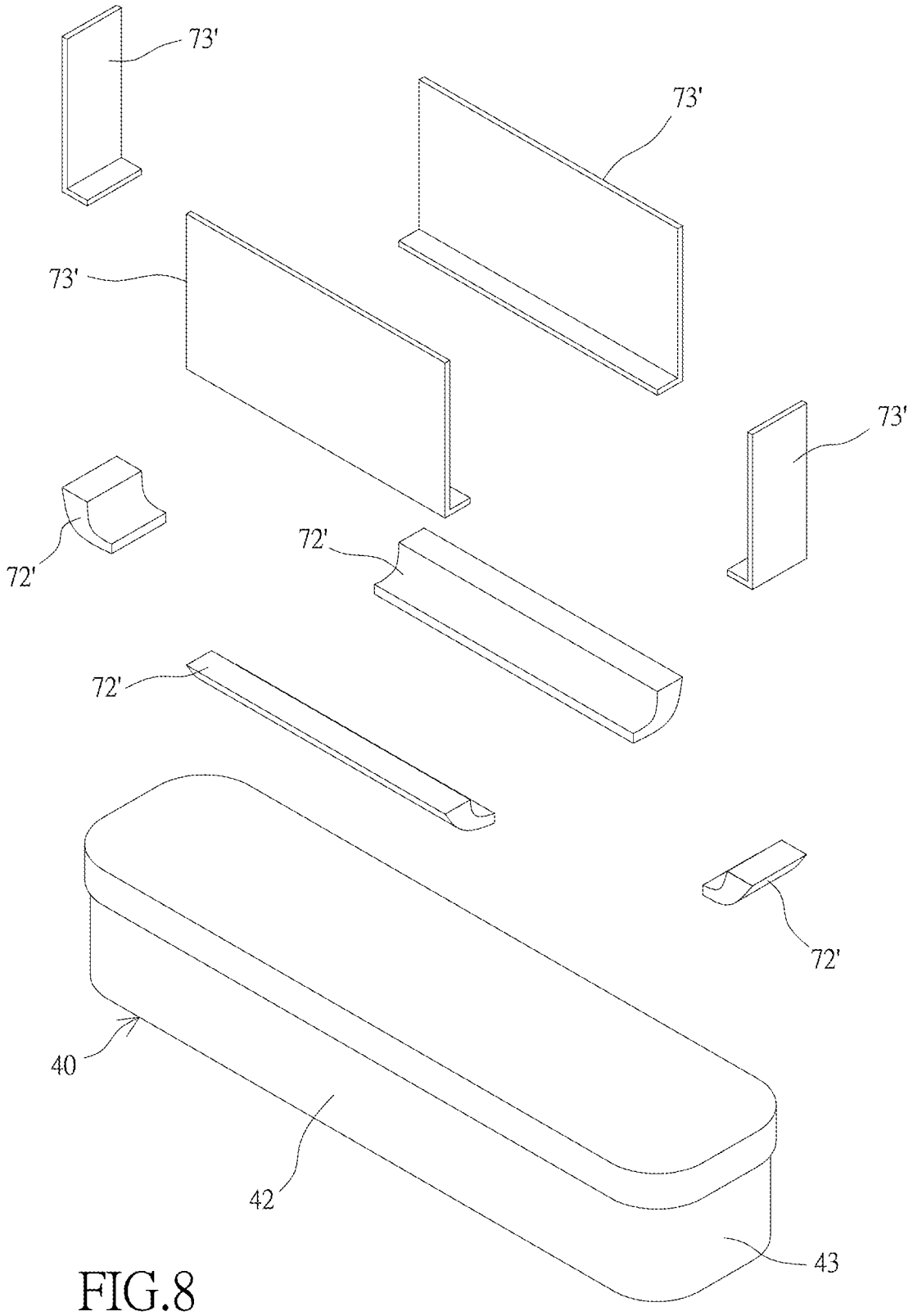
FIG. 8 is an exploded schematic view of the third embodiment mode of the elastic connecting member of the present invention and the magnet.

Referring to FIG. 1, FIG. 7, and FIG. 8, in the present embodiment, frame mounts 73' are respectively disposed on the outer sides of the two long sides 42 and the two short sides 43 of the magnet 40. An elastic member 72' is respectively connected between each of the frame mounts 73' and each of the long sides 42 and between each of the frame mounts 73' and each of the short sides 43. Accordingly, when the voice coil 60 is causing amplitudes of vibration on the exterior of the magnet 40, the elastic members 72' are able to similarly maintain the clearance 61 between the voice coil 60 and the magnet 40, thus preventing rubbing therebetween, which thereby further enables effectively improving the sound emitted by the micro speaker 10.

In summary, referring to FIGS. 1 to 8, in the present invention, the primary configuration disposes the elastic connecting member 70 between the voice coil 60 and the magnet 40, and regardless of whether the frame mounts 73, 73' and the elastic members 72, 72' are disposed on the outer sides of the arc-shaped sides 44 of the magnet 40 or are disposed on the outer sides of the two long sides 42 and the short sides 43 of the magnet 40, both configurations are able to effectively maintain the clearance 61 between the voice coil 60 and the magnet 40, which enables effectively preventing rubbing between the voice coil 60 and the magnet 40 when the voice coil 60 is causing amplitudes of vibration on the exterior of the magnet 40. Further, the present invention reduces the distance between the voice coil 60 and the outer casing 20, thereby realizing an effective reduction in the size of the entire micro speaker 10, and thus further achieving the requirement for microminiaturization.

In conclusion, the present invention clearly complies with the essential elements as required for a new invention patent, thus, a new patent application is proposed herein. It is of course to be understood that the embodiments described herein are merely illustrative of the principles of the invention and that a wide variety of modifications thereto may be effected by persons skilled in the art without departing from the spirit and scope of the invention as set forth in the following claims.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A micro speaker capable of preventing voice coil rubbing, comprising at least:

an outer casing, a center of which is provided with a holding space, the holding space is provided with a first end and a second end corresponding thereto;

a diaphragm, which is assembled on a first end of the holding space;

a magnet, which has an axis perpendicular to the diaphragm, the magnet is assembled on the second end of the holding space and is separated from the diaphragm;

a voice coil, one end of which encircles an outer side of the magnet, the other end is connected to the diaphragm, a signal voltage fed into the voice coil drives the diaphragm to extend in direction of the axis to produce amplitudes of vibration; and an elastic connecting member, which is connected between the voice coil and the magnet to enable maintaining a clearance between the voice coil and the magnet, the elastic connecting member reduces amplitudes of deflection from being produced along the axis while the voice coil is causing amplitudes of vibration, wherein the elastic connecting member further comprises at least a frame and at least an elastic member; the frame is used to support the weight of the voice coil, and the elastic member is connected between the frame and the magnet.

2. The micro speaker capable of preventing voice coil rubbing according to claim 1, wherein the frame is further assembled from a plurality of frame mounts, each of which is separated from each other; moreover, the elastic members are respectively disposed between each of the frame mounts and the magnet.

3. The micro speaker capable of preventing voice coil rubbing according to claim 2, wherein a connecting rod is further used to connect between each of the mutually separated frame mounts.

4. The micro speaker capable of preventing voice coil rubbing according to claim 2, wherein the magnet assumes an oblong shape and comprises two corresponding long sides and two correspondingly short sides; each of the long sides and each of the short sides are adjacent to each other with an arc-shaped side formed therebetween.

5. The micro speaker capable of preventing voice coil rubbing according to claim 4, wherein each of the frame mounts is disposed on the outer side of each of the arc-shaped sides; moreover, each of the elastic members is connected between each of the frame mounts and each of the arc-shaped sides.

6. The micro speaker capable of preventing voice coil rubbing according to claim 4, wherein the frame mounts are respectively disposed on the outer sides of the two long sides and the two short sides; moreover, the elastic members are respectively disposed between each of the frame mounts and each of the long sides and each of the short sides.

7. A micro speaker capable of preventing voice coil rubbing according to claim 1, comprising at least:

an outer casing, a center of which is provided with a holding space, the holding space is provided with a first end and a second end corresponding thereto;

a diaphragm, which is assembled on a first end of the holding space;

a magnet, which has an axis perpendicular to the diaphragm, the magnet is assembled on the second end of the holding space and is separated from the diaphragm;

a voice coil, one end of which encircles an outer side of the magnet, the other end is connected to the diaphragm, a signal voltage fed into the voice coil drives the diaphragm to extend in direction of the axis to produce amplitudes of vibration; and an elastic connecting member, which is connected between the voice coil and the magnet to enable maintaining a clearance between the voice coil and the magnet, the elastic connecting member reduces amplitudes of deflection from being produced along the axis while the voice coil is causing amplitudes of vibration, wherein an attaching layer is further provided on the exterior surface of the magnet.

8. A micro speaker capable of preventing voice coil rubbing according to claim 1, comprising at least:

an outer casing, a center of which is provided with a holding space, the holding space is provided with a first end and a second end corresponding thereto;

a diaphragm, which is assembled on a first end of the holding space;

a magnet, which has an axis perpendicular to the diaphragm, the magnet is assembled on the second end of the holding space and is separated from the diaphragm;

a voice coil, one end of which encircles an outer side of the magnet, the other end is connected to the diaphragm, a signal voltage fed into the voice coil drives the diaphragm to extend in direction of the axis to produce amplitudes of vibration; and an elastic connecting member, which is connected between the voice coil and the magnet to enable maintaining a clearance between the voice coil and the magnet, the elastic connecting member reduces amplitudes of deflection from being produced along the axis while the voice coil is causing amplitudes of vibration, wherein the outer casing is further assembled from a weight bearing seat and a main casing, wherein the first end is formed on the weight bearing seat and used to support the weight of the diaphragm; the second end is formed on the main casing and circumferentially located on an exterior of the voice coil; moreover, the weight bearing seat is assembled on an upper portion of the main casing.

9. The micro speaker capable of preventing voice coil rubbing according to claim 8, wherein the diaphragm and the weight bearing seat are formed as an integral body; moreover, the diaphragm is formed on the weight bearing seat formed by an injection molding with silicone material.

10. The micro speaker capable of preventing voice coil rubbing according to claim 1, wherein an attaching layer is further provided on the exterior surface of the magnet.

11. The micro speaker capable of preventing voice coil rubbing according to claim 1, wherein the outer casing is further assembled from a weight bearing seat and a main casing, wherein the first end is formed on the weight bearing seat and used to support the weight of the diaphragm; the second end is formed on the main casing and circumferentially located on an exterior of the voice coil; moreover, the weight bearing seat is assembled on an upper portion of the main casing.

12. The micro speaker capable of preventing voice coil rubbing according to claim 11, wherein the diaphragm and the weight bearing seat are formed as an integral body; moreover, the diaphragm is formed on the weight bearing seat formed by an injection molding with silicone material.

* * * * *